US005279713A

United States Patent [19]

Wessiepe et al.

[11] Patent Number: 5,279,713

[45] Date of Patent: Jan. 18, 1994

[54] DOOR

[75] Inventors: Klaus Wessiepe, Essen; Wilhelm Stewen, Oberhausen, both of Fed. Rep. of Germany

[73] Assignee: Ruhrkohle Aktiengesellschaft, Essen, Fed. Rep. of Germany

[21] Appl. No.: 847,296

Related U.S. Application Data

[63] Continuation in part of PCT/EP90/01492 on Sep. 6, 1990.

[22] Filed: Mar. 6, 1992

[30] Foreign Application Priority Data

Sep. 8, 1989 [DE] Fed. Rep. of Germany ..... 8910715

[51] Int. Cl.[5] ..... C10B 25/06

[52] U.S. Cl. ..... 202/248; 202/268; 202/269

[58] Field of Search ..... 202/248, 268, 269

[56] References Cited

U.S. PATENT DOCUMENTS

| | | | |
|---|---|---|---|
| 3,298,930 | 1/1967 | Hartman et al. | 202/248 |
| 4,118,284 | 10/1978 | Bowman et al. | 202/248 |
| 4,197,163 | 4/1980 | Aikman | 202/248 |
| 4,217,177 | 8/1980 | Gerding et al. | 202/248 |
| 4,414,072 | 11/1983 | Breidenbach et al. | 202/248 |

FOREIGN PATENT DOCUMENTS

| | | | |
|---|---|---|---|
| 0290791 | 11/1988 | European Pat. Off. . | |
| 3528511 | 8/1986 | Fed. Rep. of Germany | 202/248 |
| 3729400A1 | 3/1989 | Fed. Rep. of Germany . | |

*Primary Examiner*—Joye L. Woodard

*Attorney, Agent, or Firm*—Nils H. Ljungman & Associates

[57] ABSTRACT

A door is equipped on its side facing the area to be closed off, with a sealing element disposed around the peripheral edges of the door, a door locking device to retain the door in a closed position, and possibly a thermal layer for insulating the door from passage of heat therethrough.

14 Claims, 5 Drawing Sheets

DOOR

CROSS-REFERENCE TO RELATED APPLICATION

This application is a continuation-in-part of International patent application PCT/EP 90/01492 filed Sep. 6, 1990.

BACKGROUND OF THE INVENTION

Field of the Invention

This invention relates to a door having a separate seal element for sealing the door to the door frame, a locking element for retaining the door in a closed position, and an insulating material lining the door.

Background Information

Door structures are essentially designed for providing a few basic functions: closing door openings and preventing thermal losses. As such, typical door structures generally include a few basic features such as locking means for retaining the door in a closed position, and insulating devices for preventing thermal losses either through, or around the peripheral edges of the door. To provide the most effective prevention of heat transfer, typical doors generally include some sort of peripheral edge seal for sealing the door to the door frame, and an insulating material disposed within the door structure or on a surface of the door.

Known door structures, such as those shown in U.S. Pat. Nos. 4,683,032, 4,740,271, and 4,741,809, include sealing elements for sealing the door to the door frame. Such sealing elements are generally disposed on at least one of: the door and the door frame, and are essentially compressed between the door and the door frame when the door is in the closed position to thereby provide a tight seal about the door to prevent thermal losses from one side of the door to the other.

Several known door structures, such as those disclosed in U.S. Pat. Nos. 4,740,271, 4,683,032, 4,647,342, 4,254,974, 4,028,193, 3,953,063 and 3,902,274, disclose locking devices for retaining the doors in a closed position. With the door properly locked, the sealing elements can optimally perform their insulating functions by providing proper sealing to prevent thermal losses from one side of the door to the other.

Additional known door structures, such as those disclosed in U.S. Pat. Nos. 4,086,145, and 4,414,072, include thermal shielding or insulating material to protect the door and shield it from excess temperatures as well as to prevent losses through the door itself.

Known doors can also include cap plugs or stoppers made of refractory material when the temperature from which the door is to be protected is extremely high. These cap plugs or stoppers project away from the door, into the chamber to prevent thermal losses of the chamber and significant temperature increases of the door fixtures, such as door frames, wall protection plates, and door bodies. The known refractory cap plugs are very heavy and therefore require correspondingly stable door bodies to support the plugs, and powerful door lifting devices to place the doors onto the chambers.

Typical doors, when properly sealed, can also prevent passage of gasses from one side of the door to the other. For example, to prevent gas from escaping into the atmosphere when a coking process is occurring on one side of a door, in particular as a result of the elevated gas pressure which occurs on the doors during the early hours of the process, known doors have also used door plugs which have a box-like structure and consist of highly-refractory steel. The steel boxes thereby form a gas collecting chamber which extends along the coke oven door in the longitudinal direction. This chamber is accessible to the vaporized or gaseous coking products through openings in the chamber walls. In practice, however, it has been shown that such steel boxes are subjected to severe deformations from the heating and cooling stages which the boxes are subjected to. Such deformations essentially can result in the loss of sufficient clearance between the plugs and the wall of the coke oven chamber, which clearance is necessary for raising and replacing the coke oven door.

For thermally resistant doors, problems have also been experienced with the use of door shields which consist of overlapping sheets of refractory steel. For coke oven doors, these door shields are generally held onto the door body by means of spacers. Such door shields represent an improvement over the box-shaped door plugs, but they essentially still undergo significant deformation. In addition, the refractory steel becomes more and more brittle the longer it is in use.

To eliminate the disadvantages of metal shields, known thermally resistant doors also include the use of shields made of ceramic plates. To achieve sufficient mechanical strength, these ceramic plates must be very thick and can only be used in rather small sizes. Apart from their great weight, the mounting and attachment of the ceramic shields on the door body is problematic because of the different coefficients of expansion that exist between the metal doors and the ceramic plates.

German laid-open patent application number 37 15 711 discloses a cap plug for a coke oven chamber door, which cap plug has a box-like structure and is made of mats. The mats are cemented, using gunite, with refractory material. The plug itself consists of a single piece of the cemented material and extends over the entire height of the door. Thus, every different door height requires a separate negative mold or form to be used for the making of each different plug. In addition, the gunite cementing process is labor-intensive, and the attachment of the plugs to the door body is very expensive.

OBJECTS OF THE INVENTION

The objects of the invention are to simplify the construction of a box-shaped door cap plugs or stoppers made of ceramic material, and to simplify the attachment of the door plugs to the chamber door.

SUMMARY OF THE INVENTION

Starting with a chamber door of the type described above, the invention consists of the fact that the plugs preferably consist of a plurality of molding pieces located adjacent one another in the vertical direction of the door. These moldings preferably have an "Ω" (Omega) shaped cross section, and the ends of the legs of the moldings in contact with the door body are preferably equipped with flange-like projections which point outward and run parallel to the door body. These flange-like projections of the moldings are for the attachment of fastening means to hold the moldings onto the door. Preferably, the individual moldings forming the cap plugs consist of refractory ceramic material, which refractory material can be equipped with an internal steel reinforcement. The manufacture of the moldings can take place on jolt-ram molding machines, or high-pressure squeeze molding machines, in negative molds which have the desired dimensions of the finished molding.

The invention also specifies that the moldings forming the cap plugs are preferably located one on top of another, in a vertical direction, with the interposition of a layer or mat of a refractory insulation material between each adjacent pair of moldings. The thickness of the refractory layer is preferably designed so that there is a distance of approximately 10 mm between the individual moldings when the moldings are assembled and installed on a door. The moldings are preferably in contact with the door body, on both sides of the door body in the vicinity of the flanges, by means of two attached brackets, to thereby fix the position of the individual moldings on the door body.

According to one embodiment of the invention, the brackets preferably consist of a base plate bolted to the door body, to which base plate are fastened two additional plates running perpendicular to the face plate. One of the additional plates, the one which forms the abutment itself, runs in the direction transverse to the door plug, while the other plate forms a guide and extends several mm from the inner wall of the molding in the longitudinal direction of the plug. It has been found to be appropriate for the two plates to be oriented in relation to one another so that they have the shape of a "T" that has one shorter leg and one longer leg. In an arrangement of moldings, in which one molding is positioned above another in the vertical direction, the shorter leg of the "T" plate acts as a guide and preferably extends into the molding positioned thereabove, and the longer leg of the "T" plate extends into the molding located therebelow.

The invention specifies that the moldings are preferably fastened to the door plate in the vicinity of the gap formed between pairs of individual moldings. This fastening is generally accomplished by means of threaded bolts, which are fastened in the door plate, while other types of fastening means can also be used. Onto the threaded bolt, a threaded nut can be screwed, and it is preferable that the threaded nut presses a rectangular bar against the surface of the flange-like projections. This bar preferably overlaps both of the two adjacent moldings of a pair of moldings located one above the other.

It has been found appropriate to screw counter nuts, or at least two additional nuts, onto the threaded bolts to provide a spacing means for adjusting the space between the moldings and the door plate. By using at least two nuts positioned side by side, which nuts can be adjustably positioned on the bolt, and then rigidly maintained in a fixed position, the gap width between the molding and the door plate can preferably be set at approximately 6 mm.

One aspect of the invention resides broadly in a door assembly for substantially closing off a door opening, the door opening having an outer periphery, the door assembly having a first surface. The door assembly comprises: a frame member for being disposed about and adjacent to an outer surface of the periphery of the door opening: a sealing element for being disposed on the frame member adjacent the outer surface of the periphery of the door opening, to substantially seal the door opening when the door assembly is in a closed position; a door locking device for being disposed on at least one of the door assembly and the frame member, the locking device for retaining the door assembly in a closed and sealed position against the frame member; a thermal insulating device disposed adjacent the first surface; and the thermal insulating device being spaced apart from the first surface to form an air chamber between the first surface and the thermal insulating device.

BRIEF DESCRIPTION OF THE DRAWINGS

One embodiment of the invention is illustrated in the accompanying drawings, in which.

DESCRIPTION OF THE PREFERRED EMBODIMENT

Figure 1:
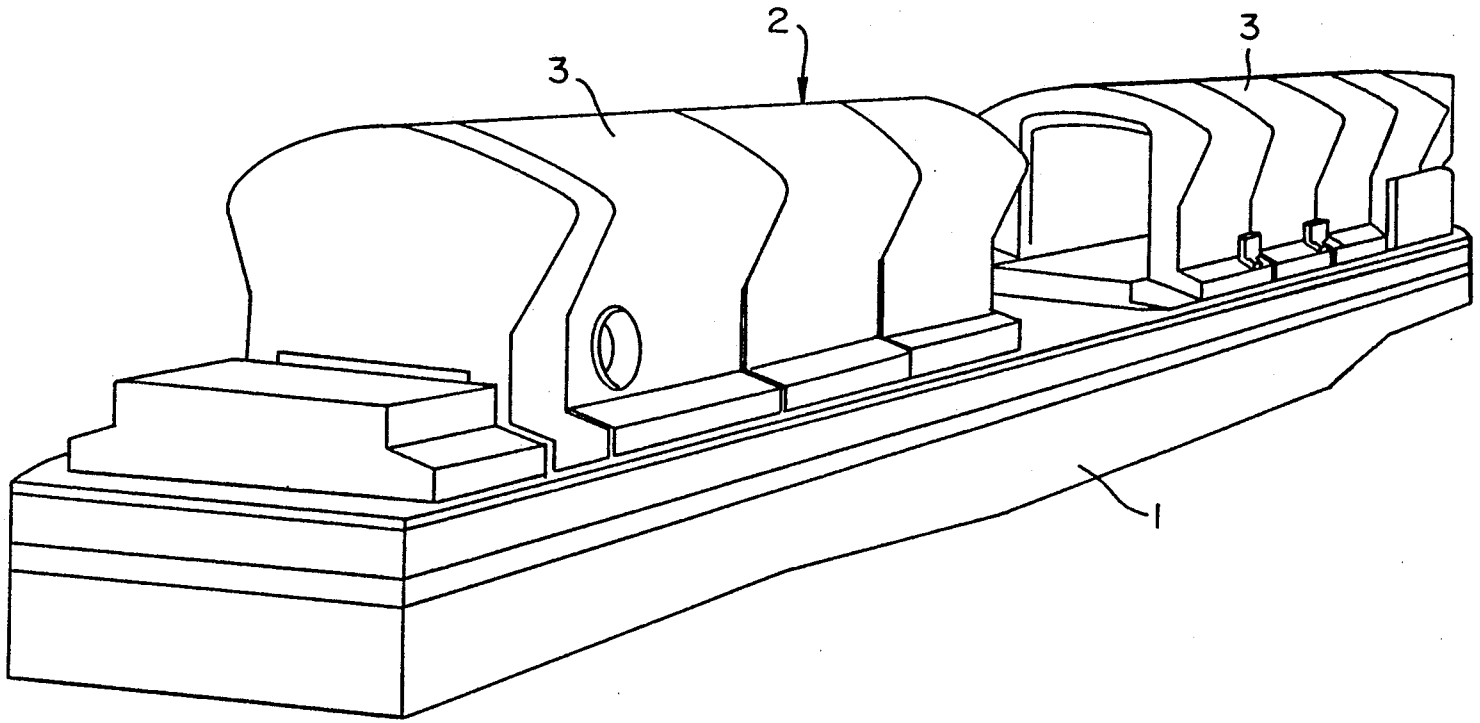
FIG. 1 shows a perspective view of a door with a hollow cap plug or stopper.
Figure 1A:
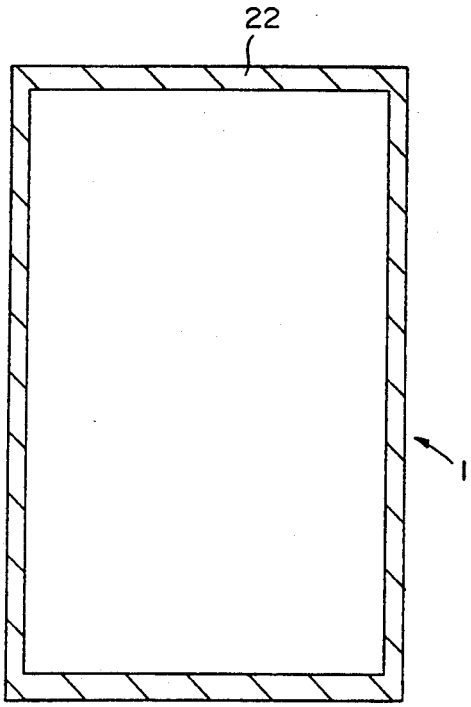
FIG. 1*a* shows a door structure having a seal disposed in the proximity of its peripheral edge.

FIG. 1*a* shows a typical door structure 20 which preferably includes a sealing means 22 disposed in the proximity of the edge of the door. As such, the sealing means can make contact with the door frame when the door 20 is in the closed position to provide a seal against the passage of gasses or heat around the peripheral edges of the door. Such a seal 22 could also be disposed about the door frame to contact the door when the door is in the closed position.

Figure 1B:
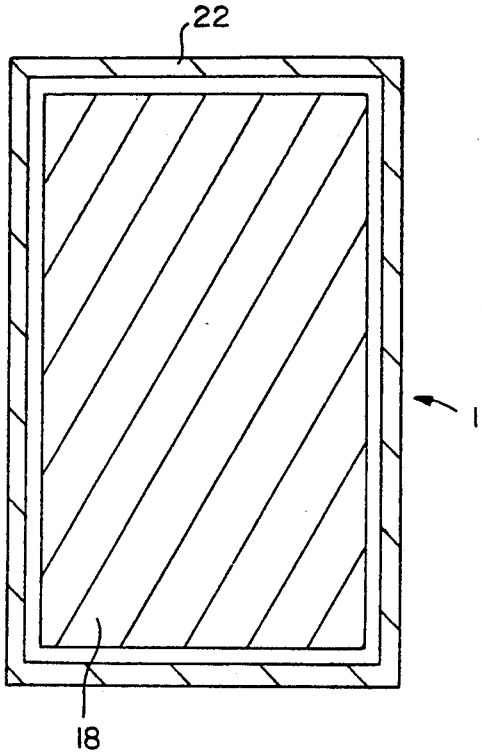
FIG. 1*b* shows a door structure similar to that of FIG. 1, but which also includes an insulating material.

To further protect the door 20 from heat, and to prevent heat transfer through the door 20, the door 20 can also be equipped with shielding means, or insulation 24, disposed at a surface of the door as shown in FIG. 1*b* , or within the interior of the door itself if protection of the door surface is not a critical factor.

Figure 1C:
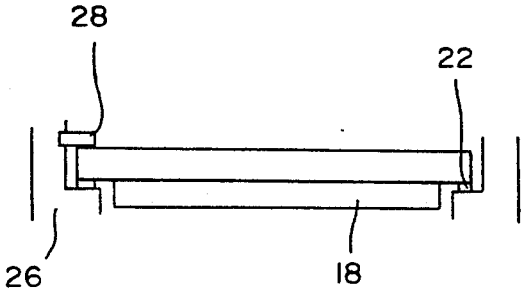
FIG. 1*c* shows an end view of the door structure of FIG. 1*a;*

FIG. 1*c* shows a door assembly in the closed position against a frame 26. The door 20 can be maintained in such a closed position by the locking device 28.

FIG. 1 shows a schematic illustration of a door 1 having a hollow cap plug or stopper 2. This hollow plug 2, according to the present invention, preferably consists of individual pieces, or moldings 3 located adjacent one another.

Figure 2:
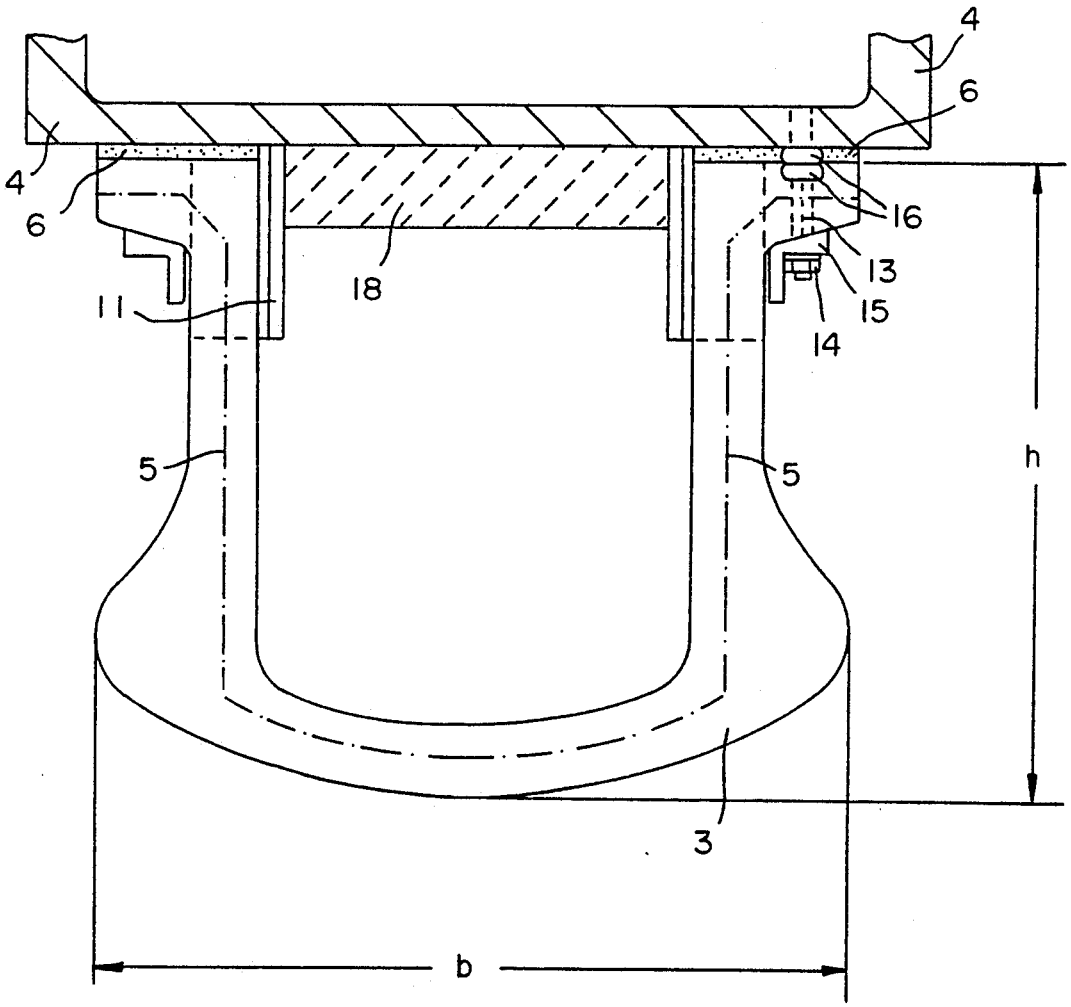
FIG. 2 shows an end view of a molding piece of the plug attached to the door plate of the door body.

FIG. 2 shows an end view of an individual molding 3. This molding 3 is shown attached to the door plate 4 of the door. The molding 3, when viewed from the end, preferably has the shape of an "Ω" (Omega). The moldings 3, which preferably are made from ceramic material, can be manufactured by forming the moldings in negative molds on jolt-ram molding machines, or high pressure squeeze molding machines. The moldings 3 can also preferably be made to include an internal reinforcement indicated by the dashed line 5. This reinforcement can preferably be constructed of non-rusting steel, such as stainless steel. The shape and dimensions of the moldings 3 are preferably adapted to the corresponding width of the chamber for which they will be used. For example, in a typical door for a coke oven, the width b can be approximately 500 mm and the height h can be approximately 400 mm. Short ceramic moldings with a length 1 (see FIG. 4) of approximately 500 mm have essentially been found to be appropriate, and a precise adaptation to the respective door height can easily be made by using a combination of moldings, with one or more of the moldings having shorter or longer lengths to attain a desired overall length.

Figure 4:
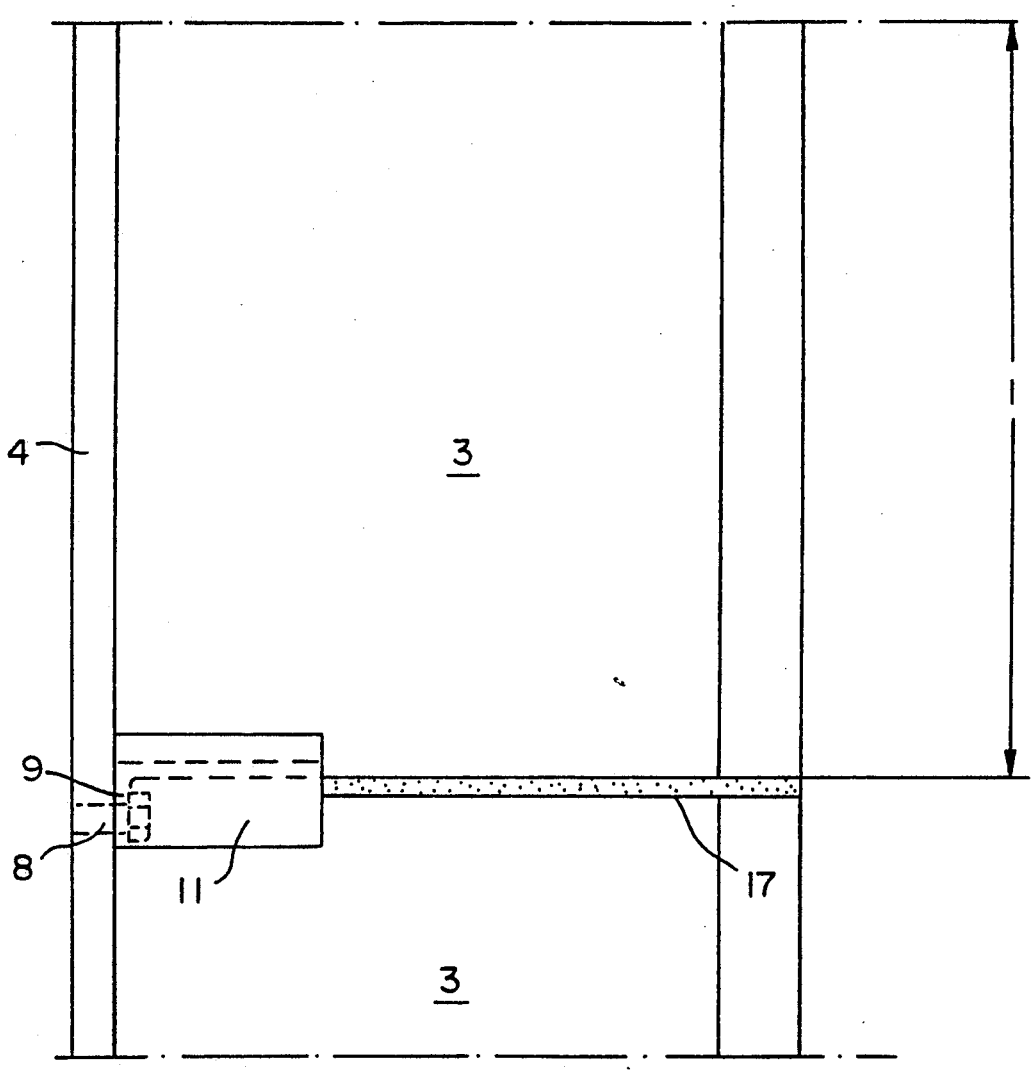
FIG. 4 shows a side view of the molding pieces illustrated in FIG. 3, taken along the line IV—IV in FIG. 3.

As shown in FIG. 4, to form a hollow plug for the door, the required number of moldings 3 can be placed adjacent one another, with the interposition of a strip 17 of a refractory insulating material between adjacent moldings 3. This strip 17 can preferably be approximately 10 to 15 mm thick. As shown in FIG. 2, the moldings 3 can be fastened to the door body or the door plate 4 also preferably with the interposition of refractory insulation material 6 between the moldings 3 and the door plate 4.

Figure 3:
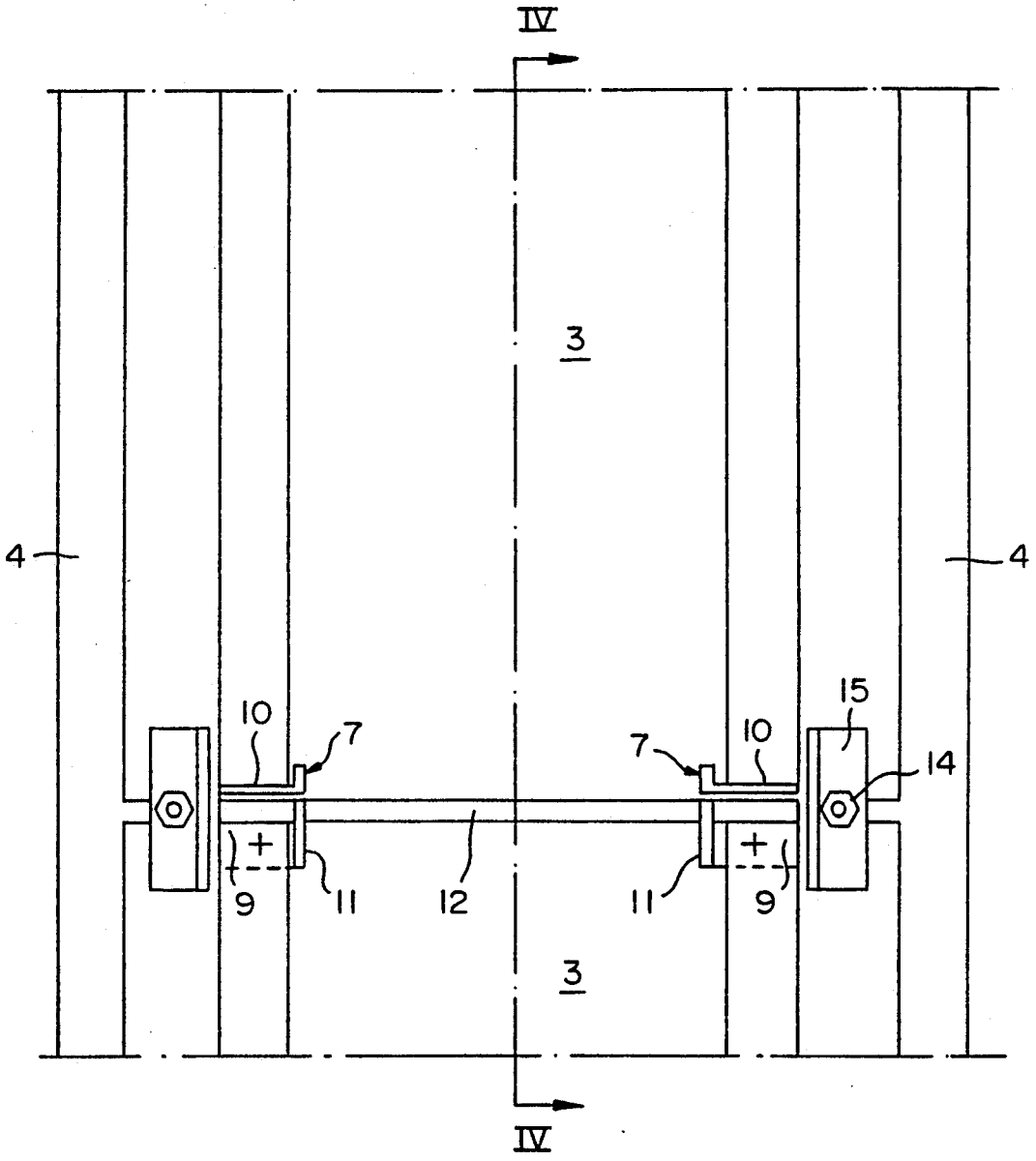
FIG. 3 shows, in the vicinity of the connection plane, a plan view of two molding pieces located adjacent one another.

The individual moldings, as shown in FIG. 3, are preferably in contact on both sides of the moldings with brackets 7. The brackets 7 preferably consist of a base plate 9 connected rigidly to the door body by some fastening means, e.g. by means of a bolt 8. Fastened to the base plate 9 are preferably two additional plates 10, 11, which additional plates 10, 11 essentially run perpendicular to the base plate 9. One of the additional plates, the plate 10 which forms the abutment itself, runs transverse to the door plug, while the other plate 11 forms a guide and preferably extends in the longitudinal direction of the cap plug at a distance of several millimeters from the inner wall of the moldings. The two plates 10, 11 are preferably connected to one another, i.e., possibly by welding, so that the two plates 10, 11 form a non-uniform "T". The plate 11 is then preferably disposed between two adjacent moldings such that the shorter leg of the plate 11 extends into one molding, and the longer leg extends into the other molding. With a vertical arrangement of moldings, the shorter leg preferably extends upwardly into the molding located above the plate 11, and the longer leg preferably extends into the molding located therebelow.

The intermediate spaces 12 (FIG. 3) between pairs of adjacent moldings 3 can preferably be filled with refractory insulating material 17. On both sides of the moldings 3, in the vicinity of the flange-like projections, threaded bolts 13 can be fastened through the space 12, into the door plate 4. These threaded bolts 13 can extend beyond the flange-like projections. The moldings 3 can then be fastened to the door plate 4 by means of a rectangular bar 15, the shape of which matches the surface of the flange-like projections. This bar 15 is preferably held in place by threaded nuts 14.

The rectangular bar 15 is essentially pressed against the surface of the flange-like projections as the nut 14 is tightened onto the bolt 13. The bar 15 is preferably configured so that it partly overlaps at least a portion of two adjacent moldings. By releasing the corresponding bar, individual moldings can be replaced with new ones if they become damaged, without the necessity of replacing the entire plug, as was formerly the case.

The spacing between the moldings 3 and the door plate 4 can also preferably be adjustable by using an adjustable spacer disposed between the moldings 3 and the door plate 4. One type of adjustable spacer which can be used is simply a pair of additional nuts, or counter nuts 16. These counter nuts, can be screwed onto the bolt 13 to provide a spacing means for adjusting the gap between the door plate 4 and the moldings. By tightening the nuts, one against the other, a rigid stop can be provided on the bolt 13 to thereby maintain a desired spacing between the door plate 4 and the moldings 3. Recesses can preferably be provided in the contact surfaces of the moldings for receipt of the nuts. These counter nuts are typically used to set the gap width between the molding and the door plate to preferably approximately 6 mm.

If desired, inside the plug, a mat 18, preferably made of refractory insulating material, can be glued to the door plate 4 over preferably the entire length of the door plate 4. This mat 18 can preferably have a thickness of approximately 50 mm, however the thickness can be adjusted as desired depending on the configuration needed.

The moldings can also be fastened to the door plate in another manner, e.g. by means of a flexible fasteners. Such flexible fasteners can be fastened to the brackets 7 to grip the moldings 3 in a hook-like fashion from behind. These flexible fasteners are able to adapt to possible deformations of the door plate, if the door plate is made of sheet metal.

This invention relates to a chamber door for a coke oven, which chamber door is equipped, on its side facing the coke oven chamber, with a hollow stopper or plug constructed of refractory material. The hollow area within the stopper defines a gas collecting chamber that extends in the longitudinal direction of the chamber door. This gas collecting chamber is accessible to the gaseous coking products through several openings distributed over the length of the stopper.

The stopper is essentially made from "Ω" shaped molding pieces located adjacent one another with the flange like ends of the moldings in contact with the door body. These flange like projections essentially run parallel to the door body for the attachment of the fastening means to the door.

In summary, one feature of the invention resides broadly in a coke oven chamber door which is equipped on its side facing the coke chamber with a hollow cap plug or stopper consisting of refractory material, which forms a gas collecting chamber extending in the longitudinal direction accessible to the gaseous coking products, and with several openings distributed over its length, characterized by the fact that the plug 2 consists of moldings 3 arranged one above another, which have an "Ω" (Omega) shaped cross section, and that the ends of the legs of the moldings 3 in contact with the door body 1, 4 are provided with flange-like projections pointing outward and running parallel to the door body, for the attachment of fastening means.

Another feature of the invention resides broadly in a coke oven chamber door characterized by the fact that the individual moldings 3 forming the plug 2 consist of refractory ceramic material, and are equipped with an internal steel reinforcement.

Yet another feature of the invention resides broadly in a coke oven chamber door characterized by the fact that the moldings 3 forming the plug 2 are located above one another with the interposition of a layer or mat 17 made of refractory insulating material, whereby the thickness of the layer is selected so that there is a distance of approximately 10 mm between the individual moldings 3 in the assembled state, and that the moldings 3 are fastened to the door plate 4 with the interposition of a layer of refractory insulating material 6.

A further feature of the invention resides broadly in a coke oven chamber door characterized by the fact that the individual moldings 3 are in contact on both sides, in the vicinity of the flange-like projections, with two brackets 7 attached to the door body.

Another additional feature of the invention resides broadly in a coke oven chamber door characterized by the fact that the brackets 7 consist of a base plate 9 bolted to the door body, and to which are fastened two plates 10, 11 running perpendicular to it, the one plate of which, forming the abutment itself 10, runs in the transverse direction to the door plug, while the other plate 11 forms a guide and extends in the longitudinal direction of the plug at a distance of several millimeters from the inside wall of the hollow body 3.

Another additional feature of the invention resides broadly in a coke oven chamber door characterized by the fact that the two plates are oriented in relation to one another so that they form a non-uniform "T", whereby the shorter leg of the plate 11 extends into the molding above, and the longer leg extends into the molding below.

Another additional feature of the invention resides broadly in a coke oven chamber door characterized by the fact that the moldings 3 are fastened to the door plate 4 in the vicinity of the gap formed between the individual moldings on both sides with threaded bolts 13, which are fastened in the door plate 4 and on which a nut 14 can be screwed, which presses a bar 15 against the surface of the flange-like projections, which partly overlaps two moldings located one above the other.

Another additional feature of the invention resides broadly in a coke oven chamber door characterized by the fact that counter nuts 16 are screwed onto the threaded bolts, and can be adjusted so that the width of the gap between the moldings 3 and the door plate 4 is approximately 6 mm.

All, or substantially all, of the components and methods of the various embodiments may be used with at least one embodiment or all of the embodiments, if any, described herein.

The invention as described hereinabove in the context of the preferred embodiments is not to be taken as limited to all of the provided details thereof, since modifications and variations thereof may be made without departing from the spirit and scope of the invention.

What is claimed is:

1. A door assembly for substantially closing off a door opening, said door assembly having a longitudinal dimension, and said door assembly comprising:

a door plate, the door plate having a first surface;

frame member means disposed about and defining an outer periphery of the door opening;

a sealing element disposed on said frame member means adjacent the outer periphery of the door opening to substantially seal the door opening when said door plate is in a closed position;

door locking means disposed on at least one of the door plate and the frame member means, said locking means for retaining said door plate in a closed and sealed position against said frame member means;

thermal insulating means disposed adjacent said first surface;

said thermal insulating means being spaced apart from said first surface to form a gas collecting chamber between the first surface and the thermal insulating means;

said first surface of the door plate has a central portion disposed along the longitudinal dimension of the door assembly, a first side portion and a second side portion disposed along the longitudinal dimension of the door assembly, said first side portion and said second side portion each being disposed on its opposite side of the central portion;

said thermal insulating means comprises a plurality of individual segments;

each of said plurality of individual segments being disposed adjacent at least one other said segment along the longitudinal dimension of said door assembly;

each of said plurality of individual segments comprises:

a first arm portion disposed along the first side portion of the door plate;

a second arm portion disposed along the second side portion of the door plate; and a connecting portion disposed to connect said first arm portion to said second arm portion at a distance away from said first surface of said door plate to form said gas collecting chamber within said individual segments;

each of said first arm portion and said second arm portion of said individual segments comprise flange means extending away from said gas collecting chamber to form external flanges, said external flanges being disposed adjacent said first surface of the door plate;

said adjacent segments are disposed spaced apart from one another by a first distance to form a first gap;

said first arm portion and said second arm portion of said segments are disposed spaced apart from said door plate by a second distance to form a second gap; and fastening means configured for contacting said external flanges and retaining said external flanges adjacent the first surface, said fastening means comprising:

at least two threaded bolts fastened o the door plate, at least one of said at least two threaded bolts being fastened at each of said first side portion and said second side portion of the door plate, said at least two threaded bolts being disposed within at least a portion of said first gap;

bar means disposed about each of said at least two threaded bolts to at least partially overlap at least a portion of said external flanges of said adjacent segments;

a threaded nut disposed on each of said at least two threaded bolts, each said threaded nut for being turned onto each of said at least two threaded bolts to tighten said bar means against said external flanges of said adjacent segments; and spacing means for adjusting said second distance of said second gap.

2. The door assembly according to claim 1, wherein:

said connecting portion is substantially curvilinear;

said individual segments are formed of at least a refractory ceramic material; and said door assembly further comprises refractory insulating material disposed within said first gap and said second gap.

3. The door assembly according to claim 2, wherein:

said door plate comprises bracket means, said bracket means being attached to said door plate;

each of said segments has a first end and a second end, said first end and said second end being disposed in alignment with said longitudinal dimension; and each of said first end and said second end of said first arm portion and said second arm portion of said segments being disposed in contact with said bracket means, said first end of said first arm portion of one segment and said second end of said first arm portion of an adjacent segment being disposed in a first of said bracket means on said first side portion of said door plate, and said first end of said second arm portion of said one segment and said second end of said second arm portion of said adjacent segment being disposed in an additional one of said bracket means on said second side portion of said door plate.

4. The door assembly according to claim 3, wherein said door plate has a length and a width, and said bracket means comprises:

a first part fastened to the first surface of the door plate;

a second part disposed substantially perpendicularly to said first part and substantially aligned along the length of said door plate;

a third part disposed substantially perpendicularly to said first part and substantially perpendicularly to said second part and substantially aligned along the width of said door assembly, said third part and said second part substantially forming a "T"-shape;

said third part divides said second part into a first arm part and a second arm part, said second arm part being shorter than said first arm part;

said third part being disposed at least partially within said first gap; and said second part being spaced apart a third distance from at least one of said first arm portion and said second arm portion to define a third gap.

5. The door assembly according to claim 4, wherein:

said spacing means comprise at least two additional threaded nuts threaded onto each of said at least two threaded bolts;

said at least two additional nuts are disposed within said second gap;

said at least two additional nuts are tightened against one another to form a rigid spacing element on said at least two threaded bolts;

said door assembly is a door for a coke oven;

said door assembly is for being disposed with the length of said door plate in a vertical direction;

said segments are disposed one on top of another in the vertical direction along said door plate;

said first arm part of said second part of said bracket means extends vertically upward into a segment disposed above said bracket means;

said second arm part of said second part of said bracket means extends vertically downward into a segment disposed below said bracket means;

said refractory material has an omega-shaped cross-section;

said door plate further includes additional insulating material disposed along the first surface of said door plate within the gas collecting chamber;

said first distance is approximately 10 mm; and said second distance is approximately 6 mm.

6. A door assembly for substantially closing off a door opening, said door assembly having a longitudinal dimension, and said door assembly comprising:

a door plate, the door plate having a first surface;

frame member means disposed about and defining an outer periphery of the door opening;

a sealing element disposed on said frame member means adjacent the outer periphery of the door opening to substantially seal the door opening when said door plate is in a closed position;

door locking means disposed on at least one of the door plate and the frame member means, said locking means for retaining said door plate in a closed and sealed position against said frame member means;

thermal insulating means disposed adjacent said first surface;

said thermal insulating means being spaced apart from said first surface to form a gas collecting chamber between the first surface and the thermal insulating means;

said first surface of the door plate has a central portion disposed along the longitudinal dimension of the door assembly, a first side portion and a second side portion disposed along the longitudinal dimension of the door assembly, said first side portion and said second side portion each being disposed on its opposite side of the central portion;

said thermal insulating means comprises a plurality of individual segments;

each of said plurality of individual segments being disposed adjacent at least one other said segment along the longitudinal dimension of said door assembly;

each of said plurality of individual segments comprises:

a first arm portion disposed along the first side portion of the door plate;

a second arm portion disposed along the second side portion of the door plate;

a connecting portion disposed to connect said first arm portion to said second arm portion at a distance away from said first surface of said door plate to form said gas collecting chamber within said individual segments;

each of said first arm portion and said second arm portion of said individual segments comprise flange means extending away from said gas collecting chamber to form external flanges, said external flanges being disposed adjacent said first surface of the door plate;

fastening means configured for contacting said external flanges and retaining said external flanges adjacent the first surface;

said connecting portion is curved continuously outwardly convex from said first arm portion to said second arm portion;

each of said segments comprises a one-piece integrally molded segment;

each of said one-piece integrally molded segments comprise a reinforcement armature embedded therein;

said first arm portion is spaced a first distance from said second arm portion;

said curvilinear connecting portion defines a width;

said width of said curvilinear connecting portion is greater than said first distance from said first arm portion to said second arm portion;

said external flanges have a longitudinal dimension;

said longitudinal dimension of said external flanges being parallel to the first surface of the door plate;

ceramic refractory material disposed between said external flange and said door plate;

said adjacent segments are spaced apart from one another to form a first gap therebetween;

said door assembly further comprises ceramic refractory material disposed between said adjacent segments in said first gap; said fastening means comprising:

at least two threaded bolts fastened to the door plate, at least of said at least two threaded bolts being fastened at each of said first side portion and said second side portion of the door plate, said at least two threaded bolts being disposed within at least a portion of said first gap;

bar means disposed about each of said at least two threaded bolt to at least partially overlap said external flanges of said adjacent segments; and a threaded nut disposed on each of said at least two threaded bolts, each said threaded nut for being turned onto each of said at least two threaded bolts to tighten said bar means against said external flanges of said adjacent segments.

7. The door assembly according to claim 6, wherein said external flanges are spaced apart from said door plate a second distance, and said door plate further comprises spacing means for adjusting said second distance.

8. The door assembly according to claim 7, wherein:

said spacing means comprise at least two additional threaded nuts threaded onto each of said at least two threaded bolts;

said at least two additional nuts being disposed between said external flanges and said door plate;

said at least two additional nuts being tightened against one another to form a rigid spacing element on said at least two threaded bolts.

9. The door assembly according to claim 8, wherein:

said refractory segments have a substantially omega-shaped cross-section;

said door plate further includes additional insulating material disposed along the first surface of said door plate within the gas collecting chamber;

said refractory material comprises ceramic material molded in negative molds by one of:

jolt-ram molding, and high-pressure squeeze molding;

said reinforcement armature comprises a stainless steel reinforcement armature;

said door assembly comprises bracket means, said bracket means being attached to said door plate;

said first arm portion and said second arm portion of said segments contact said bracket means; and said bracket means comprising:

a first part fastened to the first surface of the door plate;

said door plate has a length disposed along the longitudinal dimension of said door assembly;

a second part disposed substantially perpendicularly to said first part and substantially aligned along the length of said door plate;

a third part disposed substantially perpendicularly to said first part and substantially perpendicularly to said second part and substantially aligned along the width of said door plate;

said third part being disposed at least partially between said adjacent segments in said first gap; and said second part being spaced apart a third distance from at least one of said first arm portion and said second arm portion;

said third part is connected to said second part to substantially form a "T"-shape;

said third part divides said second part into a first arm part and a second arm part;

said second arm part is shorter than said first arm part;

said door assembly is a door for a coke oven;

said segments are aligned substantially along the length of said door plate;

said door assembly is for being disposed with the length of said door plate in a vertical direction;

said segments are disposed one on top of another in the vertical direction along said door plate;

said first arm part of said second part of said bracket means extends vertically upward into a segment disposed above said bracket means; and said second arm part of said second part of said bracket means extends vertically downward into a segment disposed below said bracket means.

10. A door assembly for substantially closing off a door opening, said door assembly having a longitudinal dimension, said door assembly comprising:

a door plate, the door plate having a first surface, the first surface having a central portion disposed along the longitudinal dimension, and a first side portion and a second side portion disposed on opposite sides of the central portion;

refractory material disposed adjacent said first surface;

said refractory material comprising a plurality of individual segments of refractory material;

each of said plurality of individual refractory segments being disposed adjacent at least one other said segment along the longitudinal dimension of said door plate;

each of said plurality of individual refractory segments comprising:

a first arm portion disposed adjacent the first side portion of the door plate;

a second arm portion disposed adjacent the second side portion of the door plate; and a connecting portion connecting said first arm portion to said second arm portion at a distance away from said first surface of said door plate;

said first arm portion, said second arm portion, said connecting portion and said first surface forming a gas collecting chamber therebetween;

each of said first arm portion and said second arm portion of said refractory segments comprise flange means disposed adjacent said first surface of said door plate, said flange means extending in a direction away from said gas collecting chamber to form external flanges on said first and second arm portions;

fastening means configured for contacting said external flanges to retain said external flanges adjacent to said first surface of said door plate;

each of said external flanges has a first surface disposed adjacent the first surface of the door plate, and a second surface disposed opposite to said first surface away from the door plate; and said fastening means comprises a portion for contacting said second surface of said external flanges to hold said first surface of said external flanges against said first surface of the door plate.

11. The door assembly according to claim 10, wherein said fastening means comprise:

at least two bolts fastened to the door plate, at least one of said at least two bolts being fastened at each of said first side portion and said second side portion of the door plate; and retaining means disposed about each of said at least two bolts to at least partially overlap at least a portion of said external flanges of adjacent ones of said refractory segments; and said retaining means comprising said portion for contacting said second surface of said external flanges.

12. The door assembly according to claim 11, wherein each of said individual refractory segments comprise a one-piece integrally molded segment and said one-piece integrally molded segments comprise a reinforcement armature embedded therein.

13. The door assembly according to claim 12, wherein:

said refractory segments have a substantially omega-shaped cross-section;

said refractory material comprises molded ceramic material; and said reinforcement armature comprises a steel reinforcement armature.

14. The door assembly according to claim 13, wherein:

said retaining means further comprises:

bar means disposed about each of said at least two bolts; and a threaded nut disposed on, and for being turned onto each of said at least two threaded bolts to tighten said bar means agains said external flanges of said adjacent segments;

said adjacent refractory segments are disposed spaced apart from one another by a first distance to form a first gap;

said external flanges of each of said first arm portion and said second arm portion of said refractory segments are disposed spaced apart from said first surface by a second distance to form second gap;

said door assembly further comprises:

refractory insulating material disposed within said first gap and said second gap;

spacing means for adjusting said second distance, said spacing means comprise at least two additional threaded nuts threaded onto each of said at least two threaded bolts, said at least two additional threaded nuts being disposed between said external flanges and said first surface, and said at least two additional nuts being tightened against one another to form a rigid spacing element on said at least two threaded bolts;

bracket means, said bracket means being attached to said door plate;

each of said segments has a first end and a second end, said first end and said second end being disposed in alignment with said longitudinal dimension; and each of said first end and said second end of each of said first arm portion and said second arm portion of said segments being disposed in contact with said bracket means, said first end of said first arm portion of one segment and said second end of said first arm portion of an adjacent segment being disposed in a first of said bracket means on said first side portion of said door plate, and said first end of said second arm portion of said one segment and said second end of said second arm portion of said adjacent segment being disposed in an additional one of said bracket means on said second side portion of said door plate;

each of said bracket means comprise:

a first part fastened to the first surface of the door plate;

a second part disposed substantially perpendicularly to said first part and substantially aligned along the longitudinal dimension of said door plate;

a third part disposed substantially perpendicularly to said first part and substantially perpendicular to said second part and substantially aligned along a width of said door plate;

said third part being disposed at least partially between said adjacent refractory segments in said first gap and said second part being spaced apart a third distance from at least one of said first arm portion and said second arm portion;

said third part being connected to said second part to substantially form a "T"-shape;

said third part divides said second part into a first arm part and a second arm part;

said second arm part of said second part is shorter than said first arm part of said second part;

said door assembly is a door for a coke oven;

said refractory segments are aligned substantially along the longitudinal dimension of said door plate;

said door plate is for being disposed with the longitudinal dimension of said door plate in a vertical direction;

said segments are disposed one on top of another in the vertical direction along said door plate;

said first arm part of said second part of said bracket means extends vertically upward into a segment disposed above said bracket means; and said second arm part of said second part of said bracket means extends vertically downward into a segment disposed below said bracket means.

* * * * *

UNITED STATES PATENT AND TRADEMARK OFFICE

CERTIFICATE OF CORRECTION

PATENT NO. : 5,279,713
DATED : January 18, 1994
INVENTOR(S) : Klaus WESSIEPE et al.

It is certified that error appears in the above-indentified patent and that said Letters Patent is hereby corrected as shown below:

In Column 8, line 39, Claim 1, after 'fastened' delete "o" and insert --to--.

In Column 11, line 8, Claim 6, after the first occurrence of 'least' insert --one--.

Signed and Sealed this

Twenty-sixth Day of November 1996

Bruce Lehman

*Attest:*

BRUCE LEHMAN

*Attesting Officer*

*Commissioner of Patents and Trademarks*